US008899972B2

(12) United States Patent
Fowler

(10) Patent No.: US 8,899,972 B2
(45) Date of Patent: Dec. 2, 2014

(54) BURNER DESIGNED FOR WIDE RANGE OF INPUT RATES

(75) Inventor: Warren Fowler, Springfield, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 967 days.

(21) Appl. No.: 12/966,020

(22) Filed: Dec. 13, 2010

(65) Prior Publication Data

US 2011/0143295 A1 Jun. 16, 2011

Related U.S. Application Data

(60) Provisional application No. 61/286,161, filed on Dec. 14, 2009.

(51) Int. Cl.

| | |
|---|---|
| ***F23Q 9/00*** | (2006.01) |
| ***F23D 14/62*** | (2006.01) |
| ***F23D 14/06*** | (2006.01) |
| ***F24C 3/08*** | (2006.01) |

(52) U.S. Cl.

CPC ..... *F24C 3/08* (2013.01); *F23D 2900/14062* (2013.01); *F23D 2900/00003* (2013.01); *F23D 14/62* (2013.01); *F23D 14/06* (2013.01)

USPC ..... 431/285; 126/39 E; 126/39 H

(58) Field of Classification Search

CPC ..... F23D 14/70; F23D 2900/14062; F23D 14/06; F23D 14/08

USPC .... 431/284, 285; 126/39 E, 39 H, 39 N, 39 J, 126/39 K; 99/324–450; 239/558, 560, 553.5

See application file for complete search history.

(56) References Cited

U.S. PATENT DOCUMENTS

| | | | | | |
|---|---|---|---|---|---|
| 1,456,754 | A | | 5/1923 | Anderson | |
| 1,923,393 | A | | 8/1933 | Pickup | |
| 1,960,842 | A | * | 5/1934 | Gilbert | 431/198 |
| 1,961,084 | A | * | 5/1934 | Sherman | 431/198 |
| 2,409,129 | A | * | 10/1946 | Lange | 126/36 |
| 2,498,289 | A | * | 2/1950 | Moecker, Jr. et al. | 431/194 |
| 2,560,862 | A | * | 7/1951 | Harrison | 239/553.5 |
| 2,781,779 | A | | 2/1957 | Kindl | |
| 3,796,535 | A | | 3/1974 | De Gouville | |
| 4,968,516 | A | * | 11/1990 | Thompson | 426/233 |
| 5,328,358 | A | * | 7/1994 | Riehl | 431/266 |
| 5,408,984 | A | | 4/1995 | Maughan | |
| 5,488,942 | A | | 2/1996 | Maughan | |
| 5,842,849 | A | | 12/1998 | Huang | |
| 6,035,846 | A | | 3/2000 | Saleri | |
| 6,132,205 | A | | 10/2000 | Harneit | |
| 6,135,764 | A | * | 10/2000 | Kwiatek | 431/266 |
| 6,263,868 | B1 | * | 7/2001 | Koch et al. | 126/39 R |

(Continued)

*Primary Examiner* — Kenneth Rinehart
*Assistant Examiner* — Jason Lau
(74) *Attorney, Agent, or Firm* — Pearne & Gordon LLP

(57) ABSTRACT

A gas burner is provided with multiple fuel rings for a cooking appliance, including an inner flame ring with a plurality of inner flame ports and an outer flame ring with a plurality of outer flame ports. At least one partition wall is disposed between the inner flame ring and the outer flame ring to define an inner fuel plenum and an outer fuel plenum. A fuel port is provided to one of the inner fuel plenum and the outer fuel plenum for providing a combustible fuel-air mixture thereto. The fuel-air mixture is transferred between the inner fuel plenum and the outer fuel plenum via at least one transfer aperture.

21 Claims, 5 Drawing Sheets

(56) References Cited

U.S. PATENT DOCUMENTS

| | | | | |
|---|---|---|---|---|
| 6,315,552 | B1 | 11/2001 | Haynes et al. | |
| 6,322,354 | B1 | 11/2001 | Carbone et al. | |
| 6,325,619 | B2 * | 12/2001 | Dane | 431/284 |
| 6,332,460 | B1 | 12/2001 | Paesani | |
| 6,439,882 | B2 | 8/2002 | Haynes et al. | |
| 7,001,176 | B2 * | 2/2006 | Bettinzoli | 431/354 |
| 7,291,009 | B2 | 11/2007 | Kamal et al. | |
| 2004/0029063 | A1 * | 2/2004 | Bettinzoli | 431/354 |
| 2005/0142511 | A1 * | 6/2005 | Yam et al. | 431/285 |
| 2007/0141521 | A1 | 6/2007 | Armanni | |
| 2007/0154858 | A1 * | 7/2007 | Cadima | 431/354 |
| 2007/0218414 | A1 | 9/2007 | Harneit | |
| 2008/0206697 | A1 * | 8/2008 | Trochou | 431/284 |

* cited by examiner

BURNER DESIGNED FOR WIDE RANGE OF INPUT RATES

CROSS-REFERENCE TO RELATED APPLICATIONS

This application claims the benefit of U.S. Provisional Application No. 61/286,161, filed Dec. 14, 2009, the entire disclosure of which is hereby incorporated herein by reference.

FIELD OF THE INVENTION

The present invention relates generally to a gas burner for an appliance, and more particularly, to a gas burner designed for a wide range of inputs.

BACKGROUND OF THE INVENTION

Atmospheric gas burners are commonly used as surface units in household gas cooking appliances, and ordinarily include a cylindrical head having a number of ports formed around its outer circumference. A mixer tube introduces a mixture of fuel and air into the burner head. The fuel-air mixture is discharged through the ports and ignited to produce a flame. A large operating range is desirable for gas burners used in gas cooking appliances because such burners are often used over a wide range of inputs. Gas burners provided with two or more burner rings can enable uniform heating of the pans despite variations in the shape and size of the pans.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a gas burner is provided with multiple fuel rings for a cooking appliance, including an inner flame ring with a plurality of inner flame ports and an outer flame ring with a plurality of outer flame ports. At least one partition wall is disposed between the inner flame ring and the outer flame ring to define an inner fuel plenum and an outer fuel plenum. The inner fuel plenum is in fluid communication with the outer fuel plenum via at least one transfer aperture extending through the at least one partition wall. A fuel port is provided to one of the inner fuel plenum and the outer fuel plenum for providing a combustible fuel-air mixture thereto. The fuel-air mixture is transferred between the inner fuel plenum and the outer fuel plenum via the at least one transfer aperture.

In accordance with another aspect, a gas burner is provided with multiple fuel rings for a cooking appliance, including an inner flame ring with a plurality of inner flame ports and an outer flame ring with a plurality of outer flame ports. A bridge burner extends between the inner flame ring and the outer flame ring. At least one partition wall is disposed between the inner flame ring and the outer flame ring to define an inner fuel plenum providing fuel to the inner flame ring and an outer fuel plenum providing fuel to the outer flame ring. At least one transfer aperture is defined between the at least one partition wall and the bridge burner such that the inner fuel plenum is in fluid communication with the outer fuel plenum via the at least one transfer aperture. A single fuel port is provided to one of the inner fuel plenum and the outer fuel plenum for providing a combustible fuel-air mixture thereto. The fuel-air mixture is transferred between the inner fuel plenum and the outer fuel plenum via the at least one transfer aperture such that the fuel-air mixture for operation of both the inner flame ring and the outer flame ring is delivered via the single fuel port.

In accordance with another aspect, a gas burner is provided with multiple fuel rings for a cooking appliance, including an inner flame ring with a plurality of inner flame ports and an outer flame ring with a plurality of outer flame ports. A bridge burner extends between the inner flame ring and the outer flame ring. At least one partition wall is disposed between the inner flame ring and the outer flame ring to define an inner fuel plenum providing fuel to the inner flame ring and an outer fuel plenum providing fuel to the outer flame ring. At least one transfer aperture is defined between a terminal end of the at least one partition wall and the bridge burner such that the inner fuel plenum is in fluid communication with the outer fuel plenum via the at least one transfer aperture.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
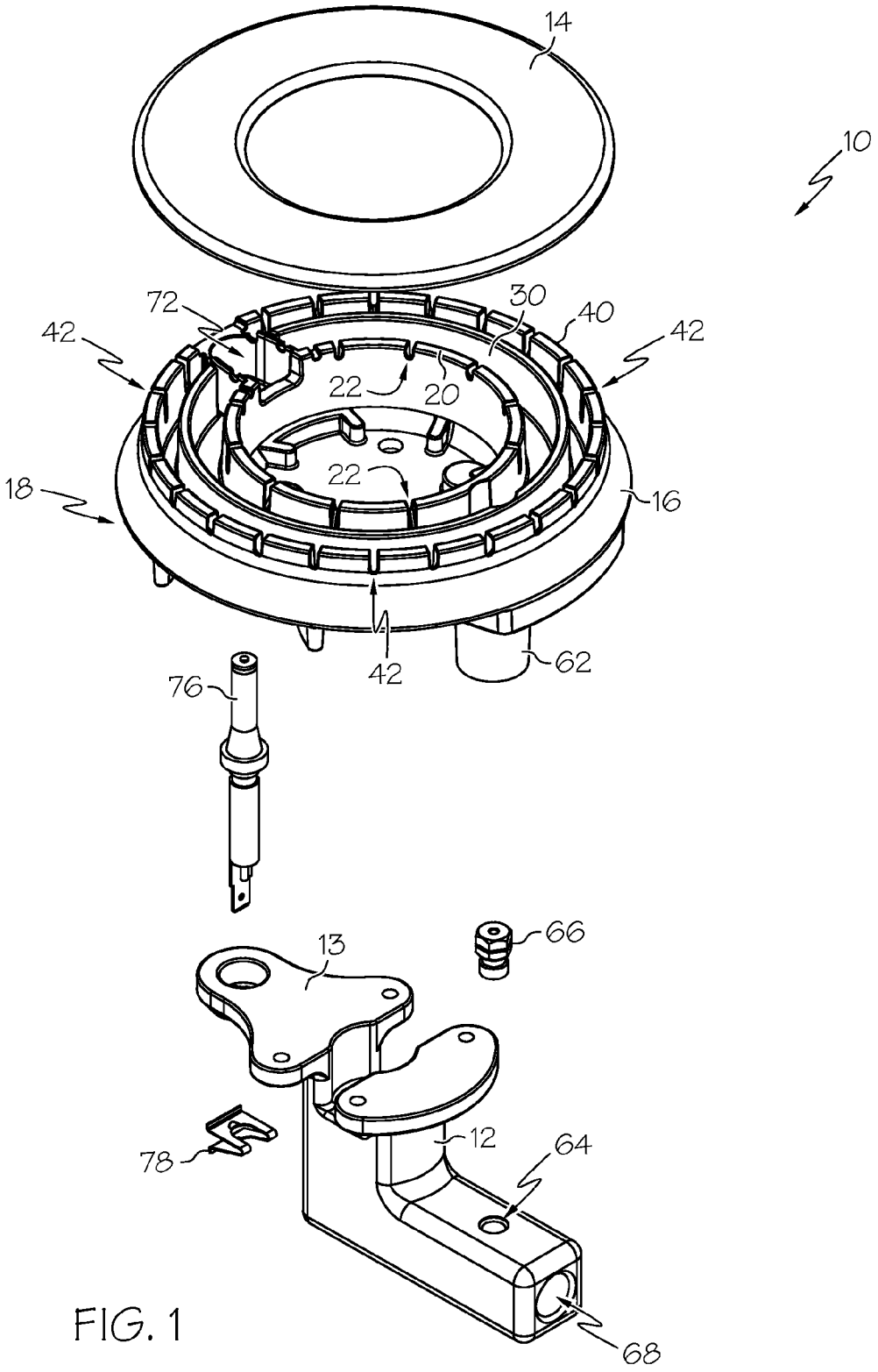
FIG. 1 provides an exploded perspective view of an example gas burner.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the example of FIG. 1, an exploded perspective view of a gas burner 10 for a cooking appliance, such as a gas cooktop, range, etc. is illustrated. The gas burner 10 offers multiple fuel rings with a wide range of input rates, and is resistant to ordinary pressure disturbances. The burner can reduce the number of conventional components, such as two separate inputs, dual valves, two separate orifices, and/or two separate gas tubes. For example, the gas burner 10 can utilize a single input, single orifice, single valve and single gas tube for multiple fuel rings.

FIG. 1 provides a perspective view of a gas burner 10 positioned atop a mounting base 12. The mounting base 12 positions the gas burner 10 on a cooktop, and aligns the gas burner 10 with the gas lines and igniter that are used during operation of the gas burner 10. The gas burner 10 provides a structure that mixes gaseous fuel with air to create a combustible mixture. Preferably, the gas burner 10 mixes the gaseous fuel and the air fairly evenly to provide hot and efficient combustion.

The gas burner 10 further includes a burner cap 14 and a burner body 16. The burner cap 14 rests on top of the burner body 16 to inhibit, such as prevent, loss of gaseous fuel from the top of the burner body 16 and provides a closed, aesthetically appealing surface for the top of the burner body 16 that deters spillage of food or liquids into the burner body 16 itself.

The burner body 16 is shown in greater detail in the remaining Figures. The burner body 16 includes a burner base 18 that is generally annular (e.g. washer-shaped), and has bottom side 19 with a generally flat portion for resting upon the cooktop. In some examples, the burner base 18 can be angled upwards by providing increased thickness on the sides thereof, which can help direct airflow along the outside of the gas burner 10.

The burner body 16 can be fabricated from a variety of suitable materials such as carbon steel, brass, or aluminum, with aluminum being preferred. However, any other suitable material such as cast iron, ceramics, or even heat-resistant plastics can be used, so long as the material used is capable of withstanding the temperatures resulting from the operation of the burner for an extended period of time and over numerous thermal cycles. The burner body 16 can be fabricated using die casting or any other suitable method known to those skilled in the art.

Figure 2:
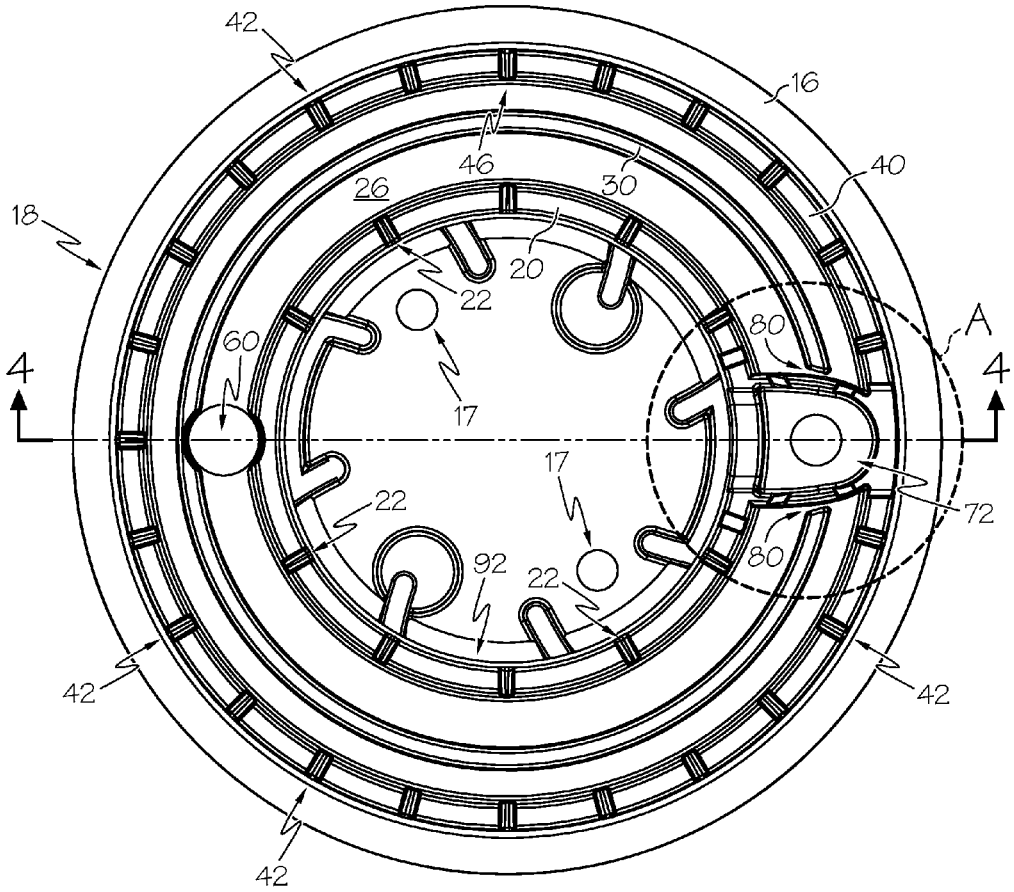
FIG. 2 provides a top view of the gas burner without the burner cap.

Turning to FIG. 2, the burner body 16 includes at least three annular walls 20, 30, 40. In one example, two or more of the walls can be concentric. The inner wall 20 contains a plurality of inner flame ports 22 that define an inner flame ring 24. Similarly, the outer wall 40 contains a plurality of outer flame ports 42 that define an outer flame ring 44. Each of the inner and outer flame rings 24, 44 can extend generally 360° around the burner body 16 and may be concentric, though can also extend along various angles that can be the same or different from each other.

At least one partition wall 30 is disposed between the inner flame ring 24 and outer flame ring 44, and does not contain any burner ports. In conjunction with the inner and outer walls 20, 40, the at least one partition wall 30 defines an inner fuel plenum 26 and a separate outer fuel plenum 46, respectively. The height of the inner wall 20, the at least one partition wall 30, and the outer wall 40 should typically be the same so that the inner and outer fuel plenums 26, 46 become closed at the top upon placing the burner cap 14 upon the burner body 16. However, the heights may differ if the burner cap 14 is designed to fit over walls having different heights while still closing off the inner and outer fuel plenums 26, 46.

As noted, both of the inner wall 20 and the outer wall 40 include a plurality of fuel exit ports, or flame ports 22, 42. The flame ports 22, 42 are apertures in the inner and outer walls 20, 40 that allow combustible, gaseous fuel within the inner and outer fuel plenums 26, 46 to exit and enter respective combustion zones where it mixes with air or any other suitable oxygen source. The number of flame ports 22, 42 can vary in different embodiments of the invention; however, sufficient flame ports 22, 42 should be provided to both encourage the even mixing of gaseous fuel with air and to allow sufficient gaseous fuel to enter the combustion zones to provide the desired level of heating.

As shown, the flame ports 22, 42 are arranged to provide two combustion zones, an inner combustion zone 50 and an outer combustion zone 52. The inner combustion zone 50 can be defined generally within the bounds of the inner walls 20, while the outer combustion zone 52 can be defined generally outside the bounds of the outer wall 40. As shown, the inner flame ports 22 forms a radially inward "internal flame" or inner flame ring during operation of the gas burner 10 in which the flames converge towards a central point within the inner combustion zone 50. Additionally, the outer flame ports 42 forms a radially outward "outer flame" or outer flame ring during operation of the gas burner 10 in which the flames extend into the outer combustion zone 52 and away from the gas burner 10.

Thus, the inner and outer combustion zones 50, 52 can be arranged generally as concentric combustion zones, with the outer combustion zone 52 having a generally greater perimeter than the inner combustion zone 50. Still, the flame ports 22, 42 can cooperate to form various flames having various geometries that extend about various portions of the burner body 16, etc. Providing both inner and outer flame ports 22, 42 can increase the amount of combustion and thus heat energy that the gas burner 10 can provide.

The flame ports 22, 42 can be any passage that allows fuel to enter the combustion zones 50, 52 from the inner and outer fuel plenums 26, 46. For example, the flame ports 22, 42 can be grooves, such as small channels, positioned in the top region of the inner and outer walls 20, 40 that extend downward into a portion of the inner and outer walls 20, 40. In one example, the flame ports 22, 42 can be generally straight channels running through the inner and outer walls 20, 40. In another example, the flame ports 22, 42 can be aligned and/or angled relative to the inner and outer fuel plenums 26, 46. By aligned, it is meant that the flame ports 22, 42 are all oriented in the same direction relative to the inner and outer walls 20, 40. For example, if one of the flame ports 22, 42 passes through the inner wall 20 at an angle of about 15 degrees in one direction, all of the flame ports 22, 42 will pass through the inner wall 20 at about 15 degrees in one direction. Angling the flame ports 22, 42 can direct the flames inwards, outwards, upwards, and/or downwards, and/or even encourage the gaseous fuel to swirl upon entering the combustion zone(s) 50, 52, as desired. The flame ports 22, 42 can be angled to a variety of different degrees relative to the center of the burner body 16, in any single axis or combination of axes.

The flame ports 22, 42 can be provided in a variety of shapes. For example, the flame ports 22, 42 can be circular tunnels passing through the inner and outer walls 20, 40. Another shape suitable for the flame ports 22, 42 are grooves positioned in the top region of the inner and outer walls 20, 40. The grooves are small channels that extend downward into a portion of the inner wall 20 from the top of the wall. Grooves provide the advantage of being somewhat easier to clean than other types of fuel exit ports if the burner body 16 is removed from the cooking appliance, as they can be readily accessed by removing the burner cap 14. When a burner cap 14 is placed over the burner body 16, the top of the grooves will be covered so that the grooves form tunnels that serve as flame ports 22, 42. The flame ports 22, 42 can vary in diameter in different embodiments, based on the desired level of gaseous fuel flow to the combustion zone(s) 40, 42. For example, the inner flame ports 22 can be generally smaller than the outer flame ports 42, such that the inner flame ring provides generally less heat than the outer flame ring. In another example, the inner flame ports 22 can be provided generally closer together, while the outer flame ports 42 can be provided generally farther apart. The flame ports 22, 42 can be arranged evenly, non-evenly, random, in a pattern or array, etc. Various configurations are contemplated.

The burner body 16 also includes a fuel port 60 provided to one of the inner fuel plenum 26 and the outer fuel plenum 46 for providing a combustible fuel-air mixture thereto. The fuel port 60 is a fuel input port opening that passes through the burner base 18 to allow combustible gaseous fuel to enter one of the inner fuel plenum 26 and the outer fuel plenum 46. In the shown example, the fuel port 60 is provided to the inner fuel plenum 26. The fuel port 60 has a diameter sufficient to allow the ready passage of gaseous fuel into the inner fuel plenum 26. For example, the fuel port 60 may have a diameter generally equal to the width of the inner fuel plenum 26. The size and positioning of the fuel port 60 can vary in different embodiments.

Figure 4:
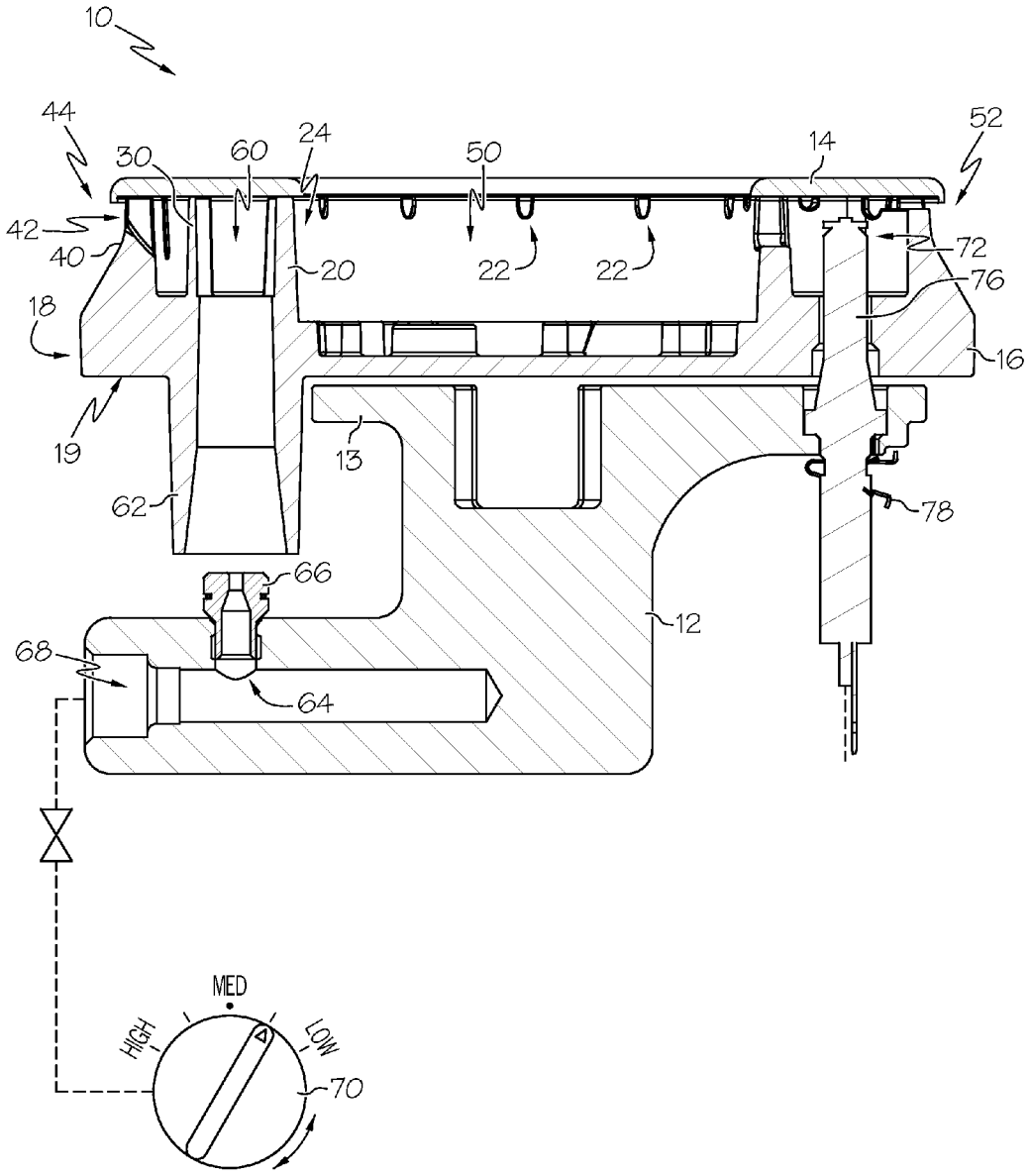
FIG. 4 provides a sectional view taken along line 4-4 of FIG. 2 of the gas burner.

As shown in FIG. 4, burner body 16 also includes a gas entry tube 62, which can be a Venturi tube, positioned under the fuel port 60 and extending downward from the bottom side 19 of the burner base 18. The gas entry tube 62 is a hollow structure that can transfer gaseous fuel, and can have a variety of shapes, such as a hollow cylinder, etc. The gas entry tube 62 should have a length sufficient to extend near a gas supply of the mounting base 12.

The mounting base 12 also includes a gas supply port 64 positioned and sized near the gas entry tube 62 of the burner body 16. For example, the gas supply port 64 can be provided with a nozzle 66 to direct the gas into the gas entry tube 62. The gas supply port 64 can be in fluid communication with a gas supply plenum 68 provided in the mounting base 12 that receives the gas from a gas supply (not shown, e.g., a gas line, etc.) via an adjustable valve 70. The adjustable valve 70, shown schematically for clarity, can be adjustable by a user to control the amount of gas flow to the fuel port 60 of the burner body 16, which can allow selective adjustment of the flame size with a low flow, high flow, intermediate flow, or a closed operating state, etc. The adjustable valve 70 can include a control knob or the like with indicia indicating an operational condition of the valve (simmer, low, medium, high, etc.).

As previously described, the gas burner 10 also includes a burner cap 14 configured to fit over both of the inner and outer fuel plenums 26, 46. The burner cap 14 typically has a geometry corresponding to that of the inner and outer fuel plenums 26, 46, such as curved or angled, having an inner edge and an outer edge that fit over the inner wall 20 and the outer wall 40, while including a curved opening similar to that of the inner combustion zone 50. The outer edge of the burner cap 14 can also include a flange that extends over the upper edge of the outer wall 40 and/or inner wall 20 to help retain the burner cap 14 in place over the burner body 16. The burner cap 14 can be formed from any suitable material capable of withstanding the temperatures resulting from the operation of the burner body 16 for an extended period of time and over numerous thermal cycles. For example, the burner cap 14 can be formed of steel, and prepared by stamping or sintering of metal powder. The burner cap 14 can simply rest upon the surface of the burner body 16, or if desired it can be further secured by attachment. The burner cap 14 can include a raised undersurface that seats in a complementary fashion between the inner and outer walls etc. so as to substantially preclude the passage of the combustible gas.

The gas burner 10 further includes a bridge burner 72 extending between the inner flame ring 24 and the outer flame ring 44. The bridge burner 72 can also be closed at the top by the removable burner cap 14. The bridge burner 72 includes a plurality of bridge flame ports 74A, 74B adapted to trigger ignition of at least one of the inner and outer flame rings 24, 44. For example, one or more bridge flame ports 74A can be arranged generally towards and/or angled towards the inner flame ports 22 of the inner flame ring 24, while one or more other bridge flame ports 74B can be arranged generally towards and/or angled towards the outer flame ports 42 of the outer flame ring 44. The inner flame ring 24 may include auxiliary flame ports 25 adjacent to the bridge flame ports 74A that can act as carry-over ports to facilitate ignition of the inner flame ring 24. The auxiliary flame ports 25 may be similar or identical to the inner flame ports 22, or may even have a different configuration. For example, the auxiliary flame ports 25 can be in gas-flow communication with the inner fuel plenum 26, but may be relatively smaller (e.g., more shallow, narrower, etc.) than the inner flame ports 22 so as to be relatively easier to ignite. Additionally, after either or both of the inner and outer flame rings 24, 44 have been ignited, the bridge burner 72 can function as a flame keeper to inhibit, such as prevent, either of the inner and outer flame rings 24, 44 from being inadvertently extinguished by local pressure disturbances.

The bridge burner 72 can be sized to accept an electric igniter 76 that can be coupled to the mounting base 12 in various manners, such as by a threaded connection or by a mechanical fastener, such as a clip 78 or the like. Gas burner igniters are known in the art; for example, various types of electronic ignition systems such as a spark ignition system can be used. In addition or alternatively, the igniter 76 can be electrically insulated from the mounting base 12. The igniter 76 is also separated from the burner body 16 and/or the burner cap 14 in such a manner that a spark gap is created between the igniter 76 and the burner body 16 and/or burner cap 14. The burner body 16 and/or burner cap 14 is electrically coupled to the appliance to provide an electrical ground path to earth. The igniter 76 is electrically coupled a power supply (not shown) for powering the igniter 76. For example, an example igniter may operate at relatively high voltage, such as 14,000 volts, and an established electrical ground path from the burner body 16 and/or burner cap 14 can help to protect the various other electronics (e.g., controls, displays, etc.) of the appliance.

The gas burner 10 can further include at least one transfer aperture 80 extending through the at least one partition wall 30 and the bridge burner 72 such that the inner fuel plenum 26 is in fluid communication with the outer fuel plenum 46 via the at least one transfer aperture 80. For example, the inner and outer fuel plenums 26, 46 can be distinct and independent, except for the communication provided by the at least one transfer aperture 80. Thus, where a single fuel port 60 provided to one of the inner fuel plenum 26 (as shown) or the outer fuel plenum 46 for providing a combustible fuel-air mixture thereto, the fuel-air mixture can be transferred between the inner and outer fuel plenums 26, 46 via the at least one transfer aperture 80 such that the fuel-air mixture for operation of both the inner flame ring 24 and the outer flame ring 44 is delivered via the single fuel port 60. It can be beneficial to locate the at least one transfer aperture 80 generally opposite the single fuel port 60 so that the inner fuel plenum 26 can be generally completely filled to supply the inner flame ring 24 prior to the fuel flowing into the outer fuel plenum 46.

Figure 3:
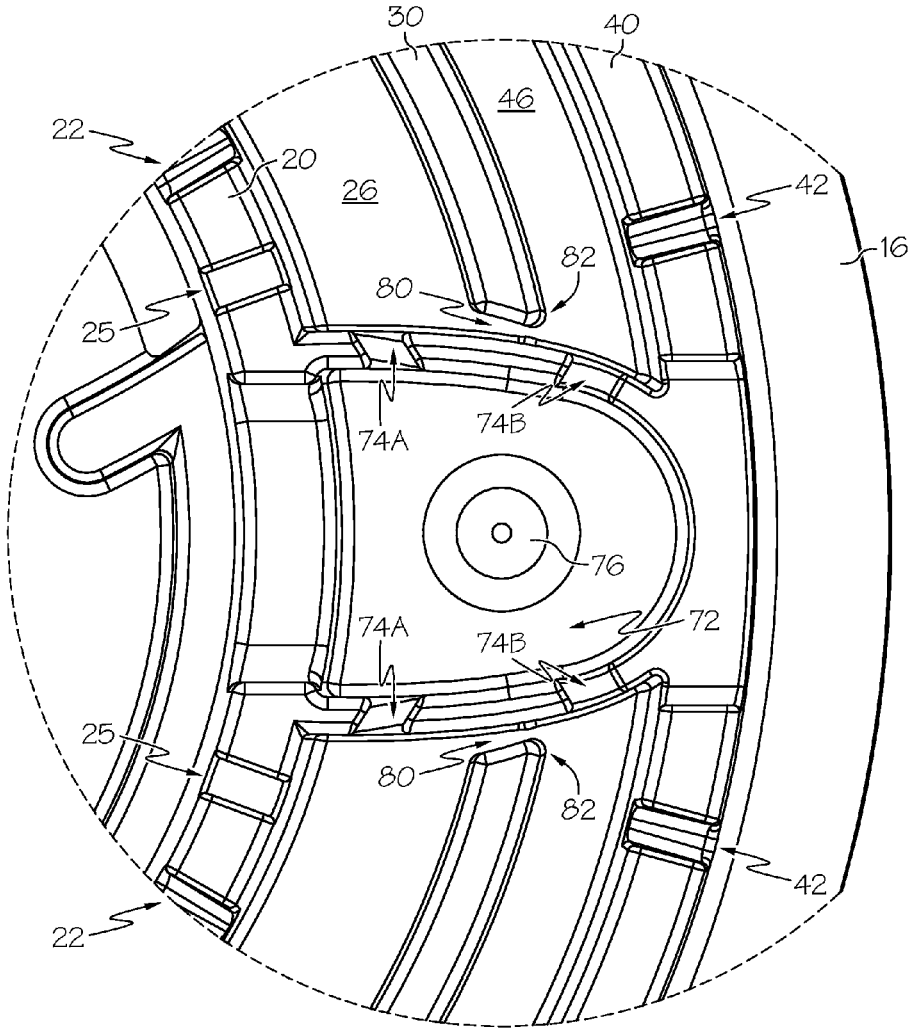
FIG. 3 provides a detail view "A" of FIG. 2.

In one example, the at least one partition wall 30 can comprise at least one terminal end 82 spaced a distance from another portion of the gas burner 10 to define the at least one transfer aperture 80. In one example, the at least one terminal end 82 can be spaced a distance from the bridge burner 72 to define the at least one transfer aperture 80. In another example, shown in FIGS. 2-3, the at least one partition wall 30 can include a pair of terminal ends 82 that can each be spaced a respective distance from the bridge burner 72 to define a pair of transfer apertures 80. Each of the pair of terminal ends 82 can be spaced similar or different distances from the bridge burner 72 such that the resulting transfer apertures 80 are generally similar or different. The at least one partition wall 30 can provide a generally continuous separation barrier between the inner and outer fuel plenums 26, 46, except for the pair of transfer apertures 80. As a result, the combustible gas can flow from the inner fuel plenum 26 and into the outer fuel plenum 46 via the pair of transfer apertures 80. In yet another example, the terminal end(s) 82 of the at least one partition wall 30 can be coupled to the bridge burner 72, and the at least one transfer aperture 80 can extend through the at least one partition wall 30 at a distance spaced away from the bridge burner 72.

The flow of the combustible fuel-air mixture between the inner and outer fuel plenums 26, 46 can be controlled variously. In one example, the inner flame ring 24 can utilize the combustible fuel-air mixture provided to the inner fuel plenum 26 for producing flames through the inner flame ports 22. The at least one transfer aperture 80 can be sized such that the fuel-air mixture remains generally within the inner fuel plenum 26 until an amount of fuel-air mixture provided to the inner fuel plenum 26 exceeds a predetermined threshold amount. Thereafter, the excess unburned fuel-air mixture provided to the inner fuel plenum 26 that exceeds the predetermined threshold amount is provided to the outer flame ring 44 via the at least one transfer aperture 80 for producing flames through the outer flame ports 42. As a result, when an amount of fuel-air mixture provided to the inner fuel plenum 26 is less than the predetermined threshold amount, substantially no fuel-air mixture is provided to the outer flame ring 44. For example, when an amount of fuel-air mixture provided to the inner fuel plenum 26 is less than the predetermined threshold amount, back pressure from the outer fuel plenum 46 can inhibit the gas flow thereto. Generally, when the amount of fuel-air mixture provided to the inner fuel plenum 26 is less than the predetermined threshold, only the inner flame ring 24 is ignited. Similarly, when the amount of fuel-air mixture provided to the inner fuel plenum 26 exceeds the predetermined threshold, then both of the inner and outer flame rings 24, 44 are ignited, though it is also contemplated that only the outer flame ring 44 may be ignited.

The predetermined threshold amount can be based upon various operational schemes. In one example, the inner flame ring 24 can utilize the combustible fuel-air mixture up to a maximum amount, and the predetermined threshold amount can be based upon the maximum amount. Where the inner flame ring 24 uses a maximum amount of fuel-air mixture, any additional unburned fuel provided to the inner fuel plenum 26 will not be utilized by the inner flame ring 24 but will instead proceed through the at least one transfer aperture 80 and into the outer fuel plenum 46 to be burned by the outer flame ring 44. In another example operational scheme, the predetermined threshold amount can be based upon an amount that is less than the maximum amount consumable by the inner flame ring 24. Thus, any additional unburned fuel provided to the inner fuel plenum 26 in excess of the threshold amount will first proceed through the at least one transfer aperture 80 and into the outer fuel plenum 46 to be burned by the outer flame ring 44. Some additional amount of fuel provided thereafter to the inner fuel plenum 26 can then be utilized by either or both of the inner and outer flame rings 24, 44. It is understood that the predetermined threshold amount can be based on various gas flow measurements, such as volumetric flow rate, mass flow rate, static or dynamic gas pressure, etc. Further, the predetermined threshold amount and/or the amount of gas flow provided to the inner and outer flame rings 24, 44 can be controlled by the size or number of the aperture(s) 80. For example, the amount of gas flow provided to the outer flame ring 44 can be relatively increased by increasing the width of any or all of the aperture(s) 80. In addition or alternatively, the predetermined threshold amount and/or the amount of gas flow provided to the inner and outer flame rings 24, 44 may also be controlled by varying the relative size (e.g., volume) of the inner and outer fuel plenums 26, 46.

During operation, at relatively low gas input rates from the single fuel port 60, the amount of fuel-air mixture is relatively low and is generally contained within the inner fuel plenum 26. The fuel-air mixture generally does not leak through the at least one transfer aperture 80 and into the outer fuel plenum 46. As a result, the inner flame ring 24 is ignited but the outer flame ring 44 remains unignited. At relatively high input rates, a relatively high amount of fuel-air mixture completely fills the inner fuel plenum 26 and is burned by the inner flame ring 24, while excess fuel-air mixture escapes through the at least one transfer aperture 80, fills the outer fuel plenum 46, and is burned by the outer flame ring 44.

As described herein, the bridge burner 72 can carry the flames between the inner and outer flame ports 22, 42. The bridge burner 72 can trigger ignition of the outer flame ring 44 subsequent to ignition of the inner flame ring 24, or even vice-versa. The bridge burner 72 can be in gas-flow communication with either or both of the inner and outer fuel plenums 26, 46, such as via the bridge flame ports 74A, 74B. In one example, where the fuel port 60 is provided to the inner fuel plenum 26, the electric igniter 76 can first ignite combustible fuel-air mixture flowing through the bridge flame ports 74A and subsequently ignite the nearby inner flame ports 22 (and auxiliary flame ports 25). Meanwhile, the remaining inner flame ports 22 continue to ignite in a progression around the inner flame ring 24 of the inner combustion zone 50. Once the amount of fuel-air mixture provided to the inner fuel plenum 26 exceeds the predetermined threshold amount and flows into the outer fuel plenum 46, the bridge burner 72 can then ignite the combustible gas flowing through the bridge flame ports 74B and subsequently ignite the nearby outer flame ports 42. Meanwhile, the remaining outer flame ports 42 continue to ignite in a progression around the outer flame ring 44 of the outer combustion zone 52.

It is to be understood that the igniter 76 can trigger ignition of any or all of the inner flame ring 24 and outer flame ring 44 in various orders. It is further understood that the igniter 76 can directly trigger ignition of any or all of the inner flame ring 24 and outer flame ring 44, or can indirectly trigger ignition, such as from one flame ring to another. It is further understood that only a portion of a particular flame ring may be burning when the ignition of another flame ring occurs. For example, while the igniter 76 can be configured to trigger ignition of the outer flame ring 44 subsequent to ignition of the inner flame ring 24, only a portion of the inner flame ring 24 may be burning when the ignition of the outer flame ring 44 is triggered.

Thus, the gas burner 10 can provide a wide range of burner turndown ratio's, using a single fuel port 60, based upon selective activation or deactivation of the inner flame ring 24 and outer flame ring 44. In one example, the gas burner 10 can provide a minimum of about 500 BTU's or about 1,000 BTU's using only the inner flame ring 24, while the inner and outer flame rings 24, 44 operating together can provide a maximum of about 10,000 BTU's. Thus, the gas burner 10 can provide a turndown ratio (i.e., maximum BTU output versus minimum BTU output) of about 10:1 (i.e., 10,000 vs. 1000), or even 20:1 (i.e., 10,000 vs 500). Of course, various other greater or lesser BTU outputs are contemplated. The described turndown ratio can be selectively adjustable by a user upon adjustment of a single valve 70 as described herein.

The gas burner 10 can include yet additional features. For example, as shown in the bottom view of FIG. 5, a plurality of vanes 90 can be positioned on the bottom side 19 of the burner body 16 and can extend towards the inner flame ring 24 (e.g., towards the inner combustion zone 50). The plurality of vanes 90 can be coupled to or formed with the burner body 16, and can be angled relative to the inner flame ring. In one example, the vanes 90 can be angled or curved, such as with a generally constant diameter or even to form a portion of a spiral pattern. Generally, a spiral is a curve which emanates from a central point, getting progressively farther away as it revolves around the point. By a portion of a spiral, what is meant is that the vanes 90 are curved so that a spiral having that angle of curvature could be overlaid thereon. Providing angled and/or curved vanes 90 can help to swirl the incoming air supply (e.g., oxygen for combustion) when it enters the inner combustion zone 50 via one or more apertures 92 for feeding the inner flame ring.

Figure 5:
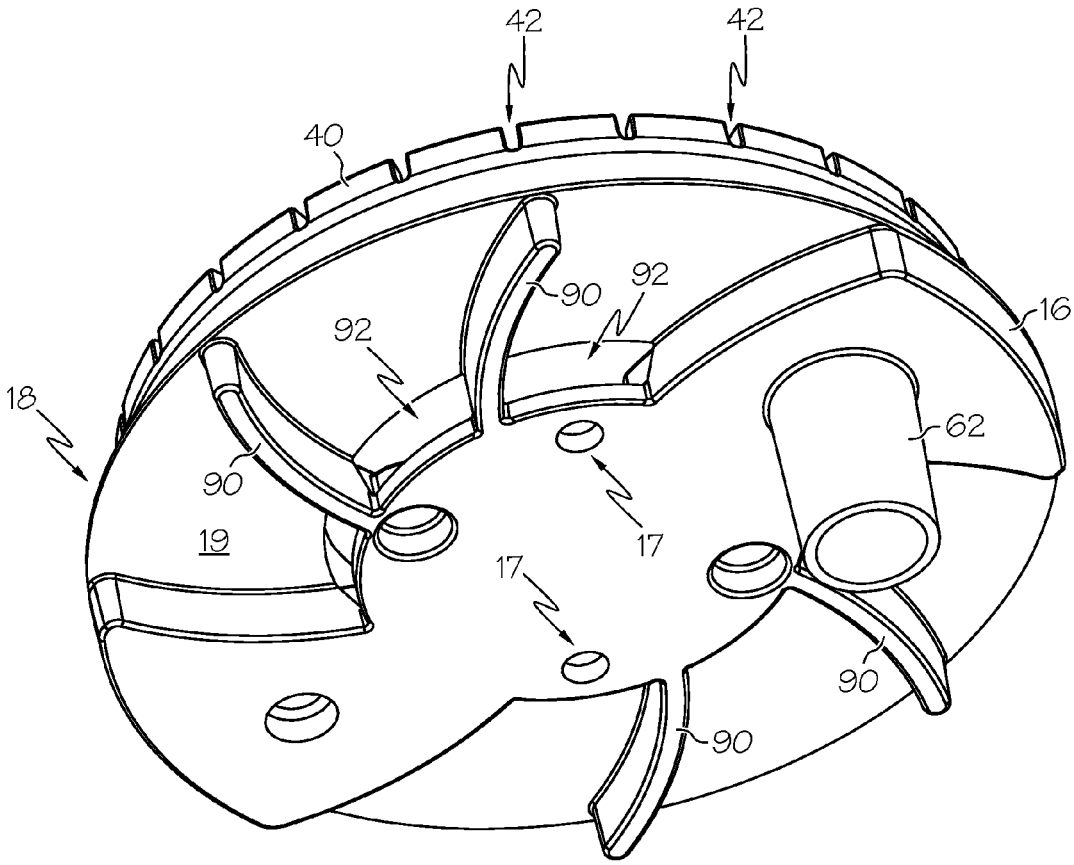
FIG. 5 is a bottom view of the gas burner.

The vanes 90 are designed to help impart a swirling motion on air as it enters the inner combustion zone 50 where it mixes with the gaseous fuel therein from the inner flame ports 22. Air is drawn into the inner combustion zone 50 by convection, as a result of the operation of the gas burner 10. The vanes 90 can have a variety of shapes that are suitable for redirecting airflow. For example, the vanes 90 can be oblong rectangular strips or beams as shown in FIG. 5. One portion of the vanes 90 can be coupled to the bottom side 19 of the burner base 18, while another end of the vanes 90 extends into a portion of the space below the inner combustion zone 50. The number and configuration of vanes 90 used can vary in different embodiments of the invention. For example, about 4-10 vanes can be used. Still, vanes 90 that are not angled or curved can also be used to guide the air flow.

The gas burner 10 can also have various additional features. The gas burner 10 is generally provided on the surface of a cooking appliance (e.g., cooktop, range, etc.). Generally, the burner body 16 and the burner cap 14 are positioned above the cooktop, whereas the mounting base 12 is not visible and is attached below the cooktop. The mounting base 12 is attached to the appliance using screws or other connective devices that run through attachment points of the mounting base 12 and the cooktop.

The burner body 16 can be mounted directly to the surface of a cooktop. If mounted in this fashion, gas lines will be installed such that they provide fuel to the burner body 16 through the gas entry tube 62. However, another embodiment of the gas burner 10 is provided with a mounting base 12 to support the gas burner 10 on a cooking appliance. The mounting base 12 can provide various functions such as supporting the gas burner 10 above a surface within the heating region of a cooking appliance (e.g., a range cooktop), facilitating air entry into the gas burner 10, aligning the gas burner 10 with the one or more gas lines, and/or simplifying the removal of the burner body 16 for cleaning. The mounting base 12 includes a securing plate 13 with a planar surface that supports the gas burner 10 and provides various attachment points for attachment to the gas burner 10 and the cooking appliance. Typically, the mounting base 12 is attached under the surface of the cooktop using screws or other connecting devices that connect with one or more attachment points. The burner body 16 can then be coupled to the mounting base 12 via screws or the like via attachment points 17 instead of directly to the surface of a cooktop. The mounting base 12 can be formed of a suitable material such as aluminum, ceramic, or stainless steel, with aluminum being preferred, and can be formed by die casting, for example.

Embodiments of the gas burner 10 can provide improved aesthetics and avoid trapping spillage within the cooking appliance. For example, embodiments of the gas burner 10 can provide a burner system that provides no top surface openings that could allow spillage to drain through the gas burner 10 into the cooking appliance or burner components. The gas burner 10 is made resistant to spillage by providing a burner cap 14 that fits over the burner body 16, resulting in a gas burner 10 that has no holes near the surface of the burner oriented in a direction that can trap spillage. This also improves the aesthetics of the cooking appliance by providing a gas burner 10 with a smooth uninterrupted surface.

Embodiments of the gas burner 10 can also provide a gas burner 10 that includes components that can be readily removed from the cooking appliance for cleaning. For example, the burner cap 14 can simply be lifted off of the burner body 16 and cleaned. The burner body 16 can also be easily removed from the mounting base 12 for cleaning. Cleaning can be carried out using typical kitchen materials, such as soap and water. The burner body 16 can be mounted to the mounting base 12 by screw attachment in which one or more screws (not shown) are run through burner mounting holes provided in the burner base 18 and into attachment points provided in the mounting base 12. Thus, in order to remove the burner body 16, one need only remove the screws used to attach the burner body 16, which can then be lifted off of the cooking appliance and cleaned. Because the gas lines are attached to the mounting base 12, the burner body 16 can be removed without disconnecting the gas lines.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A gas burner with multiple fuel rings for a cooking appliance, comprising:

an inner flame ring comprising an inward-facing wall with a plurality of inner flame ports through which a combustible gas is to be emitted and ignited to produce inward-facing flames that extend radially inward, toward a central portion of the burner;

an outer flame ring comprising an outward-facing wall spaced a greater radial distance from the central portion of the burner than the inward-facing wall, the outward-facing wall comprising a plurality of outer flame ports through which a combustible gas is to be emitted and ignited to produce outward-facing flames that extend radially outward, away from the central portion of the burner;

at least one partition wall disposed between the inward-facing wall and the outward-facing wall to define an inner fuel plenum and an outer fuel plenum, the inner fuel plenum being in fluid communication with the outer fuel plenum via at least one transfer aperture extending through the at least one partition wall, the at least one transfer aperture being defined between opposing portions of the at least one partition wall; and a fuel port provided to one of the inner fuel plenum and the outer fuel plenum for providing a combustible fuel-air mixture thereto, the fuel-air mixture being transferred between the inner fuel plenum and the outer fuel plenum via the at least one transfer aperture.

2. The gas burner of claim 1, wherein the at least one partition wall comprises a terminal end spaced a distance from another portion of the gas burner disposed between the opposing portions of the at least one partition wall to define the at least one transfer aperture.

3. The gas burner of claim 2, further comprising a bridge burner extending between the inner flame ring and the outer flame ring, wherein the terminal end of the at least one partition wall is spaced a distance from the bridge burner to define the at least one transfer aperture.

4. The gas burner of claim 1, wherein the inner gas plenum and the outer gas plenum are closed at the top by a removable outer cover placed thereupon.

5. The gas burner of claim 1, wherein the fuel port is provided to the inner fuel plenum and the inner flame ring utilizes the combustible fuel-air mixture for producing flames through the inner flame ports, and the transfer aperture is sized such that the fuel-air mixture remains generally within the inner fuel plenum until an amount of fuel-air mixture provided to the inner fuel plenum exceeds a predetermined threshold amount.

6. The gas burner of claim 5, wherein the inner flame ring utilizes the fuel-air mixture up to a maximum amount, and wherein the predetermined threshold amount is based upon the maximum amount.

7. The gas burner of claim 5, wherein excess fuel-air mixture provided to the inner fuel plenum that exceeds the predetermined threshold amount is provided to the outer flame ring via the at least one transfer aperture.

8. The gas burner of claim 5, wherein when an amount of fuel-air mixture provided to the inner fuel plenum is less than the predetermined threshold amount, substantially no fuel-air mixture is provided to the outer flame ring.

9. The gas burner of claim 1, further comprising a bridge burner extending between the inner flame ring and the outer flame ring that comprises an electric igniter and a plurality of bridge flame ports adapted to trigger ignition of the outer flame ring subsequent to ignition of the inner flame ring.

10. A gas burner with multiple fuel rings for a cooking appliance, comprising:

a relatively-inner flame ring with a plurality of inner flame ports through which a combustible gas is to be emitted and ignited to produce inward-facing flames that extend radially inward, toward a central portion of the burner;

a relatively-outer flame ring with a plurality of outer flame ports through which a combustible gas is to be emitted and ignited to produce outward-facing flames that extend radially outward, away from the central portion of the burner;

a bridge burner extending between the inner flame ring and the outer flame ring;

at least one partition wall disposed between the inner flame ring and the outer flame ring to define an inner fuel plenum providing fuel to the inner flame ring and an outer fuel plenum providing fuel to the outer flame ring, at least one transfer aperture defined between the at least one partition wall and the bridge burner such that the inner fuel plenum is in fluid communication with the outer fuel plenum via the at least one transfer aperture; and a single fuel port provided to one of the inner fuel plenum and the outer fuel plenum for providing a combustible fuel-air mixture thereto, the fuel-air mixture being transferred between the inner fuel plenum and the outer fuel plenum via the at least one transfer aperture such that the fuel-air mixture for operation of both the inner flame ring and the outer flame ring is delivered via the single fuel port.

11. The gas burner of claim 10, wherein the at least one partition wall comprises a terminal end spaced a distance from the bridge burner to define the at least one transfer aperture.

12. The gas burner of claim 11, wherein the at least one partition wall comprises two terminal ends each being spaced a respective distance from the bridge burner to define at least two transfer apertures.

13. The gas burner of claim 10, wherein the inner flame ring utilizes the combustible fuel-air mixture for producing flames through the inner flame ports, and the at least one transfer aperture is sized such that substantially no fuel-air mixture is provided to the outer flame ring until an amount of fuel-air mixture provided to the inner fuel plenum exceeds a predetermined threshold amount.

14. The gas burner of claim 13, wherein excess fuel-air mixture provided to the inner fuel plenum that exceeds the predetermined threshold amount is provided to the outer flame ring via the at least one transfer aperture.

15. The gas burner of claim 10, wherein the bridge burner comprises a plurality of bridge flame ports that are adapted to trigger ignition of the outer flame ring subsequent to ignition of the inner flame ring.

16. A gas burner with multiple fuel rings for a cooking appliance, comprising:

an inner flame ring with a plurality of inner flame ports;

an outer flame ring with a plurality of outer flame ports;

a bridge burner extending between the inner flame ring and the outer flame ring;

at least one partition wall disposed between, and concentric with the inner flame ring and the outer flame ring to separate an inner fuel plenum providing fuel to the inner flame ring from an outer fuel plenum providing fuel to the outer flame ring, and at least one transfer aperture defined between a terminal end of the at least one partition wall and the bridge burner such that the inner fuel plenum is in fluid communication with the outer fuel plenum via the at least one transfer aperture.

17. The gas burner of claim 16, wherein a single fuel port provided to one of the inner fuel plenum and the outer fuel plenum for providing a combustible fuel-air mixture thereto, the fuel-air mixture being transferred between the inner fuel plenum and the outer fuel plenum via the at least one transfer aperture such that the fuel-air mixture for operation of both the inner flame ring and the outer flame ring is delivered via the single fuel port.

18. The gas burner of claim 16, wherein the inner flame ring utilizes the combustible fuel-air mixture for producing flames through the inner flame ports, and the at least one transfer aperture is sized such that substantially no fuel-air mixture is provided to the outer flame ring until an amount of fuel-air mixture provided to the inner fuel plenum exceeds a predetermined threshold amount.

19. The gas burner of claim 18, wherein excess fuel-air mixture provided to the inner fuel plenum that exceeds the predetermined threshold amount is provided to the outer flame ring via the at least one transfer aperture.

20. A gas burner with multiple fuel rings for a cooking appliance, comprising:

an inner flame ring with a plurality of inner flame ports;

an outer flame ring with a plurality of outer flame ports;

a bridge burner extending between the inner flame ring and the outer flame ring;

at least one partition wall disposed between the inner flame ring and the outer flame ring to define an inner fuel plenum providing fuel to the inner flame ring and an outer fuel plenum providing fuel to the outer flame ring, wherein the at least one partition wall comprises two terminal ends each being spaced a respective distance from the bridge burner to define at least two transfer apertures, and wherein the inner fuel plenum is in fluid communication with the outer fuel plenum via the at least two transfer apertures.

21. The gas burner of claim 1, wherein the at least one partition wall is coaxially arranged between the inner flame ring and the outer flame ring.

* * * * *